United States Patent [19]

Izumi et al.

[11] 4,369,625

[45] Jan. 25, 1983

[54] DRIVE SYSTEM FOR CONSTRUCTION MACHINERY AND METHOD OF CONTROLLING HYDRAULIC CIRCUIT MEANS THEREOF

[75] Inventors: Eiki Izumi, Chiyodamura; Kazuo Honma, Amimachi; Katsuro Abe, Matsudo; Masaaki Uno, Toride; Kichio Nakajima, Chiyodamura, all of Japan

[73] Assignee: Hitachi Construction Machinery Co., Ltd., Tokyo, Japan

[21] Appl. No.: 123,087

[22] Filed: Feb. 20, 1980

[30] Foreign Application Priority Data

Jun. 27, 1979 [JP] Japan ..... 54-80212
Oct. 19, 1979 [JP] Japan ..... 54-134259

[51] Int. Cl.[3] ..... F16H 39/46

[52] U.S. Cl. ..... 60/327; 60/368; 60/394; 60/421; 60/422; 60/429; 414/699

[58] Field of Search ..... 60/327, 368, 394, 421, 60/422, 429, 484, 486; 91/6, 36, 530; 414/699

[56] References Cited

U.S. PATENT DOCUMENTS

| | | | |
|---|---|---|---|
| 3,247,919 | 4/1966 | Moon, Jr. | 60/484 X |
| 3,628,330 | 12/1971 | Miller | 60/368 X |
| 3,720,059 | 3/1973 | Schurawski | 60/421 |
| 3,952,511 | 4/1976 | Turner et al. | 60/486 X |
| 3,991,571 | 11/1976 | Johnson | 60/486 X |
| 4,113,054 | 9/1978 | Myers | 60/421 X |
| 4,207,740 | 6/1980 | Ripa | 91/530 X |
| 4,218,883 | 8/1980 | Pedersen | 60/429 |

OTHER PUBLICATIONS

Olhydaulik Und Pneumatik, pp. 213–222, Apr., 1976.

*Primary Examiner*—George L. Walton
*Attorney, Agent, or Firm*—Antonelli, Terry & Wands

[57] ABSTRACT

A drive system for construction machinery in which hydraulic circuit is provided with a plurality of variable-displacement hydraulic pumps and a plurality of hydraulic actuators, each pump being connected in closed circuit to one or a plurality of the actuators via a solenoid-operated valve or valves to drive a movable member or members connected to the actuator or respective actuators when pressurized fluid is supplied to the actuator or actuators from the pump. At least one of the selected hydraulic actuators is further connected in closed circuit through a solenoid-operated valve to at least one of the hydraulic pumps other than the hydraulic pump which is connected in closed circuit to the hydraulic actuator. The hydraulic circuit means is controlled such that timing for switching the solenoid-operated valves is controlled in conjunction with the operation of the pump so as to absorb the shock which would otherwise be produced when each actuator is rendered operative and inoperative. The hydraulic circuit means is further controlled such that, when the operation speed of each hydraulic actuator is increased or reduced including the time at which the actuator is rendered operative and inoperative, the speed is adjusted in conformity with the inertia and operation characteristics of a movable member connected to the actuator.

13 Claims, 12 Drawing Figures

DRIVE SYSTEM FOR CONSTRUCTION MACHINERY AND METHOD OF CONTROLLING HYDRAULIC CIRCUIT MEANS THEREOF

BACKGROUND OF THE INVENTION

This invention relates to a drive system for construction machinery, such as a hydraulic shovel, hydraulic crane, etc., and a method of controlling hydraulic circuit means of such drive system.

Heretofore, a drive system for construction machinery, such as a hydraulic shovel, hydraulic crane, etc., comprises an open-type hydraulic circuit having a plurality of hydraulic actuators receiving a supply of pressurized fluid for actuating a boom, arm, bucket and other movable members of the machinery connected thereto.

The present practice for controlling the speed of each movable member is to adjust the opening of a hydraulic directional control valve associated therewith. More specifically, this control system comprises a variable resistance provided in a hydraulic circuit by adjusting the opening of the hydraulic directional control valve, so that a loss of energy is produced in the variable resistance for controlling the speed of the hydraulic actuator. Thus, total efficiency is essentially reduced when this control system is used. With a view to operating construction machinery at a reduced energy consumption level, there have, in recent years, been many attempts made for providing improvements in the art of construction machinery. One example of such attempts is disclosed in "Olhydaulik und Pneumatik", pages 213–222, April 1976 number, which proposes to optimize control by pumps for improving the performance of excavators. The proposal contemplates connecting variable-displacement hydraulic pumps to hydraulic actuators in closed or semi-closed circuit, to control pump deliveries for controlling actuator speeds. In this closed-type hydraulic circuit system, the hydraulic pumps are only required to generate necessary power, and the energy of gravity or the energy of inertia acting on the hydraulic actuators can be absorbed by the engine via the hydraulic pumps. This enables total efficiency to be markedly increased. This system includes, in its concrete construction, a plurality of hydraulic pumps each connected in closed circuit to one or two hydraulic actuators. It is shown that when this hydraulic circuit was used for operating a hydraulic shovel, there was no need to use oil coolers until the ambient temperature has risen to 25° C. and that even in midsummer when ambient temperature rises to 40° C. the temperature of oil did not rise above 70° C. with the use of oil coolers of a capacity which is about one half that of those of the prior art. Thus, the proposed system has been proven to have effect in economizing on energy consumption.

Although the proposed closed-type hydraulic circuit has been proven to have effect in economizing on energy consumption, various problems must be obviated before it can have actual application in construction machinery. One of such problems is how to effect matching of the hydraulic pumps and hydraulic actuators in capacity. For example, in this hydraulic circuit, one hydraulic pump is connected to a boom cylinder and a travelling motor for selectively driving one of them. In this case, it is not in the interest of efficiency to design to hydraulic actuator to have a capacity such that the maximum flow rate for the boom cylinder and the maximum flow rate for the travelling motor have the same value. The boom cylinder is required to generate a high thrust and also to act at high speed. Because of this, the boom cylinder is required to have a large pressure receiving area, and it is sometimes necessary to supply fluid in high flow rate to the boom cylinder. Thus, the hydraulic pump should have a high capacity to supply fluid to the boom cylinder in an amount that satisfies its need, but it is not economical for the hydraulic pump to have a high capacity which is too high for operating the travelling motor. This is also true of the hydraulic circuit wherein a single hydraulic pump drives an arm cylinder and another travelling motor.

Another problem raised with regard to this hydraulic circuit is that limitations are placed on simultaneous operation. For example, the pressurized fluid from the hydraulic pump is used for operating the travelling motor during travelling so that neither the boom nor the arm can be operated.

SUMMARY OF THE INVENTION

This invention obviates the aforesaid problems of the prior art. Accordingly, a principal object of the invention is to provide a drive system for construction machinery comprising hydraulic circuit means including a plurality of variable-displacement hydraulic pumps and a plurality of hydraulic actuators, each hydraulic pump having one or a plurality of hydraulic actuators connected thereto in closed circuit, which drive system enables optimization of the maximum capacity of each variable displacement hydraulic pump and has versatility to allow simultaneous or compound operation of a plurality of movable members of the construction machinery.

Another object is to provide a method of and means for controlling the hydraulic circuit means of the type described wherein timing for switching solenoid-operated valves mounted between each hydraulic pump and hydraulic actuators is controlled in conjunction with the operation of the pump so as to absorb the shock which would otherwise be produced when each actuator is rendered operative and inoperative, to thereby improve the operation performance of the construction machinery.

Still another object is to provide a method of and means for controlling the hydraulic circuit means of the type described wherein, when the operation speed of each hydraulic actuator is increased or reduced including the time at which the actuator is rendered operative and inoperative, the operation speed is adjusted in conformity with the intertia and operation characteristics of a movable member connected to the actuator, whereby the movable member can operate with maximum efficiency as required without producing shock.

According to the invention, there is provided a drive system for construction machinery comprising hydraulic circuit means including a plurality of variable-displacement hydraulic pumps and a plurality of hydraulic actuators, each said pump being connected in closed circuit to one or a plurality of said actuators via a solenoid-operated valve or valves to drive a movable member or members connected to the actuator or respective actuators when pressurized fluid is supplied to the actuator or actuators from the pump, characterized in that at least one of the selected hydraulic actuators is further connected in closed circuit via a solenoid-operated valve to at least one of the hydraulic pumps other than the hydraulic pump which is connected in closed circuit to the selected hydraulic actuator.

Each said solenoid-operated valve is preferably an on-off valve.

The drive system preferably comprises means for controlling said hydraulic circuit means for setting a priority order of hydraulic communication between each hydraulic pump and the hydraulic actuators to which said hydraulic pump is connected in closed circuit via the respective solenoid-operated valves, for closing all said solenoid-operated valves when no command signals for driving said actuators are produced, for, when a command signal for driving at least one actuator is produced, opening the solenoid-operated valve associated with said one actuator or the actuator higher in the priority order of hydraulic communication with said hydraulic pump while controlling the delivery of the pump by the command signal for driving the actuator with which said opened valve is associated, for, when at least one of command signals which have been produced to drive at least one actuator is removed, closing the solenoid-operated valve associated with the actuator which have been driven by the removed command signal and/or opening or keeping open the solenoid-operated valve associated with the other actuator or actuator higher in the priority order of hydraulic communication with said hydraulic pump among the other actuators while controlling the delivery of the pump by the command signal for driving the actuator with which said opened or opening-kept valve is associated, and for conducting any switching of each said solenoid-operated valve only when the delivery of said pump is zero or has been reduced substantially to zero.

Said control means may comprise solenoid-operated valve control circuit means and hydraulic pump control circuit means, said valve control circuit means including a priority order judging circuit for judging the priority order of hydraulic communication between each hydraulic pump and the hydraulic actuators to which said pump is connected in closed circuit on the basis of command signals for driving the hydraulic actuators, a solenoid-operated valve switching timing circuit for determining the timing of switching the solenoid-operated valves on the basis of the result of judging by said priority order judging circuit and the information on the delivery of said hydraulic pump, and a solenoid-operated valve drive circuit for driving the solenoid-operated valves on the basis of the output of the switching timing circuit, and said pump control circuit means including a pump delivery calculating circuit for determining the delivery of said hydraulic pump on the basis of command signals for driving the hydraulic actuators and the result of judging by said priority order judging circuit, a pump delivery control circuit for adjusting the change rate of the delivery of said hydraulic pump on the basis of the output of the pump delivery calculating circuit.

Said control means is preferably further operative, when a command signal for increasing or reducing the operation speed of any one of said hydraulic actuators is produced, to judge for each sampling time $\Delta T$ whether or not a changing rate of the delivery of said pump is in the range of an optimized highest changing rate preset in conformity with the operation of said actuator, and to alter the changing rate of the delivery of the pump to the preset optimized highest changing rate when the former changing rate is judged to be higher than the latter changing rate, thereby adjusting the changing rate of the delivery of each pump so as to remain in the range of the optimized highest changing rate at all times.

Said control means may be adapted to adjust the changing rate of the delivery of each pump with said sampling time $\Delta T$ being constant and the optimized maximum change $\Delta Y$ in the delivery of the pump being varied for each said actuator.

Said control means may be adapted to adjust the change rate of the delivery of each pump with said sampling time $\Delta T$ being varied for each said actuator and the maximum change $\Delta Y$ in the delivery of the pump being constant.

According to the present invention, there is also provided a method of controlling hydraulic circuit means of a drive system for construction machinery in which said hydraulic circuit means includes a plurality of variable-displacement hydraulic pumps and a plurality of hydraulic actuators, each said pump being connected in closed circuit to one or a plurality of said actuators via a solenoid-operated valve or valves to drive a movable member or members connected to the actuator or respective actuators when pressurized fluid is supplied to the actuator or actuators from the pump, at least one of the selected hydraulic actuators being further connected in closed circuit via a solenoid-operated valve to at least one of the hydraulic pumps other than the hydraulic pump which is connected in closed circuit to the selected hydraulic actuator, characterized in that said method comprises: setting a priority order of hydraulic communication between each hydraulic pump and the hydraulic actuators to which said hydraulic pump is connected in closed circuit via the respective solenoid-operated valves; closing all said solenoid-operated valves when no command signals for driving said actuators are produced; when a command signal for driving at least one actuator is produced, opening the solenoid-operated valve associated with said one actuator or the actuator higher in the priority order of hydraulic communication with said hydraulic pump while controlling the delivery of the pump by the command signal for driving the actuator with which said opened valve is associated; when at least one of command signals which have been produced to drive at least one actuator is removed, closing the solenoid-operated valve associated with the actuator which have been driven by the removed command signal and/or opening or keeping open the solenoid-operated valve associated with the other actuator or actuator higher in the priority order of hydraulic communication with said hydraulic pump among the other actuators while controlling the delivery of the pump by the command signal for driving the actuator with which said opened or opening-kept valve is associated; and conducting any switching of each said solenoid-operated valve only when the delivery of said pump is zero or has been reduced substantially to zero.

Said method preferably further comprises, when a command signal for increasing or reducing the operation speed of any one of said hydraulic actuators is produced, judging for each sampling time $\Delta T$ whether or not a changing rate of the delivery of said pump is in the range of an optimized highest changing rate preset in conformity with the operation of said actuator, and altering the changing rate of the delivery of the pump to the preset optimized highest changing rate when the former changing rate is judged to be higher than the latter changing rate, thereby adjusting the changing rate of the delivery of each pump so as to remain in the range of the optimized highest changing rate at all times.

Said changing rate of the delivery of each pump may be adjusted with said sampling time ΔT being constant and the optimized maximum change ΔY in the delivery of the pump being varied for each said actuator.

Said changing rate of the delivery of each pump may be adjusted with said sampling time ΔT being varied for each said actuator and the maximum change ΔY in the delivery of the pump being constant.

DESCRIPTION OF THE PREFERRED EMBODIMENTS

Figure 1:
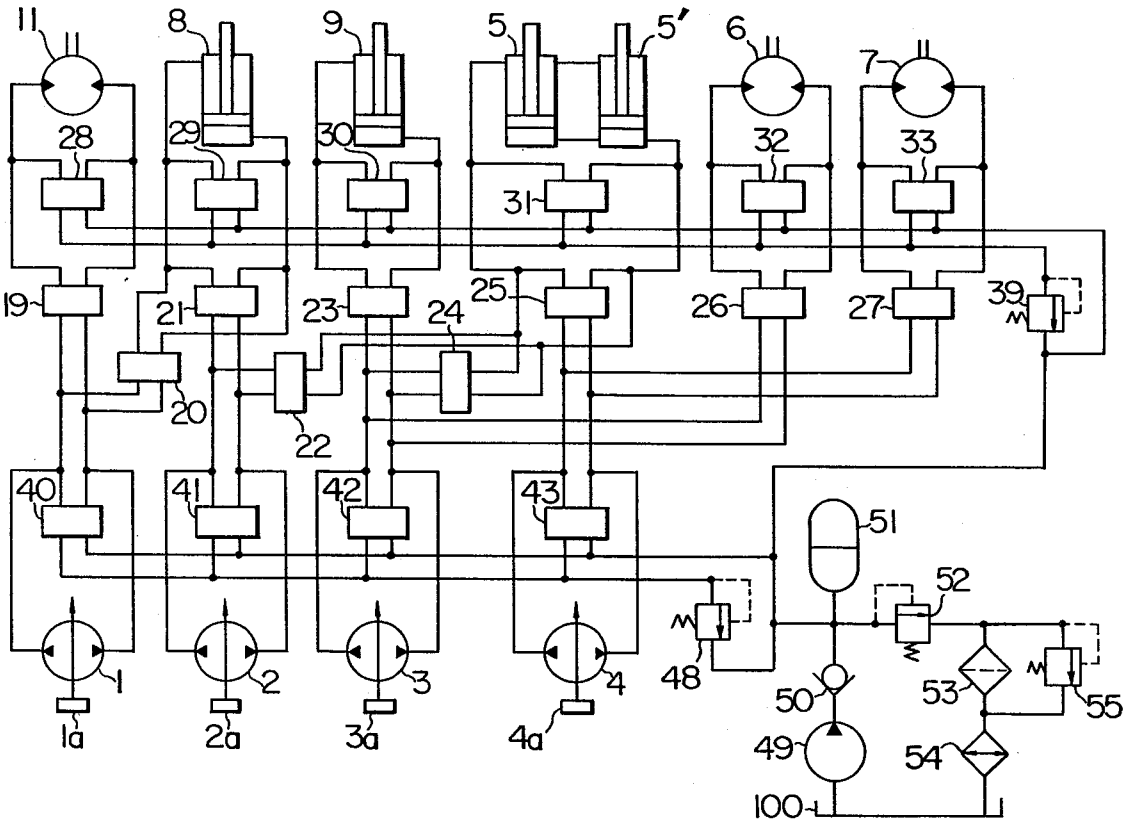
FIG. 1 is a diagrammatic representation of the hydraulic circuit means of the drive system for construction machinery comprising one embodiment of the invention.
Figure 2:
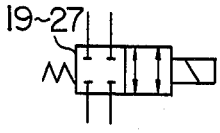
FIG. 2 is a diagram of the solenoid-operated valve used in the hydraulic circuit means shown in FIG. 1, showing its function.

Preferred embodiments of the invention will now be described by referring to the accompanying drawings. FIG. 1 shows one embodiment of the hydraulic circuit means of the drive system in conformity with the present invention as applied to a hydraulic shovel. The hydraulic circuit means comprises variable-displacement type hydraulic pumps 1–4 simultaneously driven by an engine, regulators **1*a*–4*a* for controlling the deliveries of the hydraulic pumps 1–4 respectively, and hydraulic actuators 5, 5', 6, 7, 8, 9 and 11. When the hydraulic circuit means is applied to a hydraulic shovel, the actuators 5 and 5' are boom cylinders, actuators 6 and 7 are travelling motors, actuator 8 is an arm cylinder, actuator 9 is a bucket cylinder, and actuator 11 is a swivelling motor. Pump 1 is connected in closed circuit via a solenoid-operated valve 19 to the swivelling motor 11 and via a solenoid-operated valve 20 to the arm cylinder 8. Pump 2 is connected in closed circuit via a solenoid-operated valve 21 to the arm cylinder 8 and via a solenoid-operated valve 22 to the boom cylinders 5 and 5'. Pump 3 is connected in closed circuit via a solenoid-operated valve 23 to the bucket cylinder 9, via a solenoid-operated valve 24 to the boom cylinders 5 and 5', and via a solenoid-operated valve 26 to one travelling motor 6. Pump 4 is connected in closed circuit via a solenoid-operated valve 25 to the boom cylinders 5 and 5' and via a solenoid-operated valve 27 to the other travelling motor 7. These closed circuits can be viewed from the actuator side. The arm cylinder 8 can be brought into fluid or hydraulic communication with pumps 1 and 2 via valves 20 and 21, respectively. The boom cylinders 5 and 5' can be brought into fluid communication with pumps 2, 3 and 4 via valves 22, 24 and 25, respectively. The other actuators or swivelling motor 11, bucket cylinder 9 and travelling motors 6 and 7 can be brought into fluid communication with pumps 1, 3 and 4 via valves 19, 23, 26 and 27 respectively. Valves 19–27 are on-off valves blocking all the ports when they are offset by the springs and communicating the primary side with the secondary side when energized. FIG. 2 shows the function of valves 19–27**.

Figure 3:
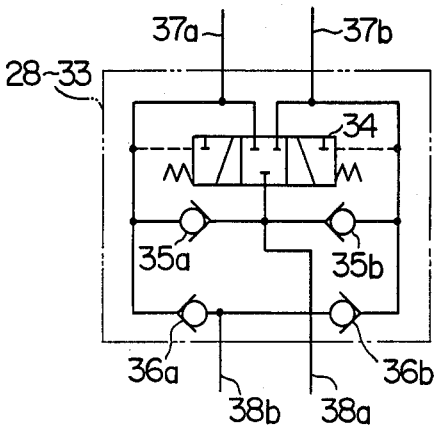
FIG. 3 is a diagram of the flushing valve unit used in the hydraulic circuit means shown in FIG. 1, showing its construction and function.

Referring to FIG. 1 again, the swivelling motor 11, arm cylinder 8, bucket cylinder 9, boom cylinders 5, 5' and travelling motors 6 and 7 have, in their main circuits flushing valve units 28–33 respectively. The construction of flushing valve units 28–33 is shown in detail in FIG. 3. More specifically, flushing valve units 28–33 each comprise a flushing valve 34 and four check valves **35*a*, 35*b*, 36*a* and 36*b*. Flushing valve 34 connects to a low-pressure conduit 38*a* the low pressure side of conduits 37*a* and 37*b* connected to the main circuit. When the pressure in either one of conduits 36*a* and 37*b* connected to the main circuit drops below the pressure in the low-pressure conduit 38*a*, pressurized fluid or oil is supplied from the low-pressure conduit 38*a* to conduit 37*a* or 37*b* via check valve 35*a* or 35*b*, to thereby avoid cavitation in the main circuit. A conduit 38*b* is connected to a relief valve 39 as shown in FIG. 1**, to avoid an inordinate pressure rise in the main circuit.

Figure 4:
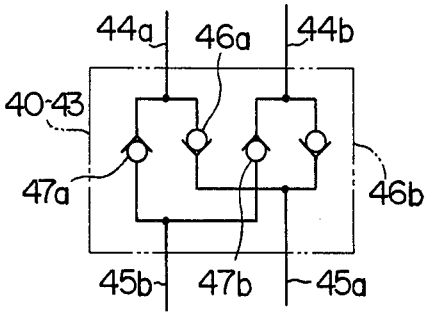
FIG. 4 is a diagram of the check valve unit used in the hydraulic circuit means shown in FIG. 1, showing its construction and function.

Pumps 1–4 have check valve units 40–43 respectively mounted in the main circuit. The construction of check valve units 40–43 is shown in detail in FIG. 4. As shown, check valve units 40–43 each comprise four check valves **46*a*, 46*b*, 47*a* and 47*b* connecting conduits 44*a* and 44*b*, which are connected to the main circuit, to conduits 45*a* and 45*b* on the low pressure side. Check valves 46*a*, 46*b*, 47*a* and 47*b* perform the same function as the check valves of flushing valve units 28–33 described hereinabove. As shown in FIG. 1, conduit 45*b* is connected to a relief valve 48**.

Referring to FIG. 1 again, 49 designates a booster pump, 50 a check valve, 51 an accumulator, 52 a low pressure relief valve, 53 a filter, 54 an oil cooler, 55 a bypass relief valve for protecting the filter 53, and 100 an oil tank.

The hydraulic circuit means according to the invention is constructed as described hereinabove. In operation, energization of valves 24 and 25 causes pressurized fluid or oil to flow in confluence from pumps 3 and 4 to the boom cylinders 5 and 5', to enable the latter to operate at high speed. Energization of valves 20 and 21 causes pressurized fluid or oil to flow in confluence from pumps 1 and 2 to the arm cylinder 8, to enable the latter to operate at high speed. Even while the travelling motors 6 and 7 are being driven by pumps 3 and 4 by energization of valves 26 and 27, the boom cylinders 5 and 5' can be operated by energizing valve 22 to cause pressurized fluid to flow thereto from the pump 2.

As aforesaid, in the hydraulic circuit means according to the invention, a plurality of hydraulic pumps can be brought into fluid communication with a specific hydraulic actuator via solenoid-operated valves. This feature enables the hydraulic pumps to be utilized effectively by reducing their capacities and allows the booms to be moved even while the machine is in motion, which has not been achieved in a hydraulic circuit of the prior art in which all the hydraulic actuators are each connected to one of the hydraulic pumps. Thus the hydraulic circuit according to the invention offers the advantage of being highly versatile and enabling a plurality of movable parts to operate simultaneously.

In FIG. 1, there is shown a combination of four hydraulic pumps, 1, 2, 3, 4, seven hydraulic actuators 5, 5', 6, 7, 8, 9, 11 and nine solenoid-operated valves 19–27. It will be understood that the versatility of the circuit can be increased by increasing the number of solenoid-operated valves.

In the hydraulic circuit means shown in FIG. 1, each hydraulic actuator has been described as being connected in closed circuit to the hydraulic pumps. The term "closed circuit" is to be understood to include, in this specification, a semi-closed circuit including a replenishing circuit for replenishing the supply of pressurized fluid or oil to the hydraulic actuator, and a flushing valve for returning excess supply of pressurized fluid from the hydraulic actuator to the tank.

The method and means for controlling the hydraulic circuit means shown in FIG. 1 will be described by referring to preferred embodiments thereof. In the hydraulic circuit means shown in FIG. 1, when valves 19 and 20 are simultaneously energized, for example, pump 1 is brought into fluid communication with the swivelling motor 11 and arm cylinder 8 simultaneously, so that there would arise the disadvantage that the speeds of the two actuators cannot be controlled independently. To avoid this trouble, the invention provides a priority order for the hydraulic actuators for coming into fluid communication with the hydraulic pumps. One example of such priority order is shown in Table 1.

TABLE 1

| | Pump | | | |
|---|---|---|---|---|
| Actuator | Hydraulic Pump 1 | Hydraulic Pump 2 | Hydraulic Pump 3 | Hydraulic Pump 4 |
| Swivel Motor 11 | 1 | | | |
| Arm Cylinder 8 | 2 | 1 | | |
| Bucket Cylinder 9 | | | 2 | |
| Boom Cylinders 5, 5' | | 2 | 3 | 2 |
| Travelling Motor 6 | | | 1 | |
| Travelling Motor 7 | | | | 1 |

Table 1 shows the conditions under which the hydraulic pumps and hydraulic actuators can be brought into fluid communication with one another in the hydraulic circuit shown in FIG. 1. Each numeral in a circle indicates the priority order for each actuator to come into fluid communication with each pump. For example, pump 1 has the highest priority for fluid communication with the swivelling motor 11, and is unable to supply pressurized fluid to the arm cylinder 8 unless there is no need for fluid communication with the swivelling motor 11. The boom cylinders 5 and 5' cannot be operated when the travelling motors 6 and 7 are being driven and the arm cylinder 8 is operating. Even if the machine is travelling as the result of the travelling motors 6 and 7 being driven, the boom cylinders 5 and 5' can be operated if the arm cylinder 8 is not operated. When the machine is not travelling, pressurized fluid can be supplied in confluence to the boom cylinders 5 and 5' from pumps 2, 3 and 4 if the bucket cylinder 9 and/or arm cylinder is not in operation. It is to be understood that a priority order is determined by the function and operability required of a particular machine and that the invention is not limited to the priority order shown in Table 1 which is not the only priority order.

Figure 5:
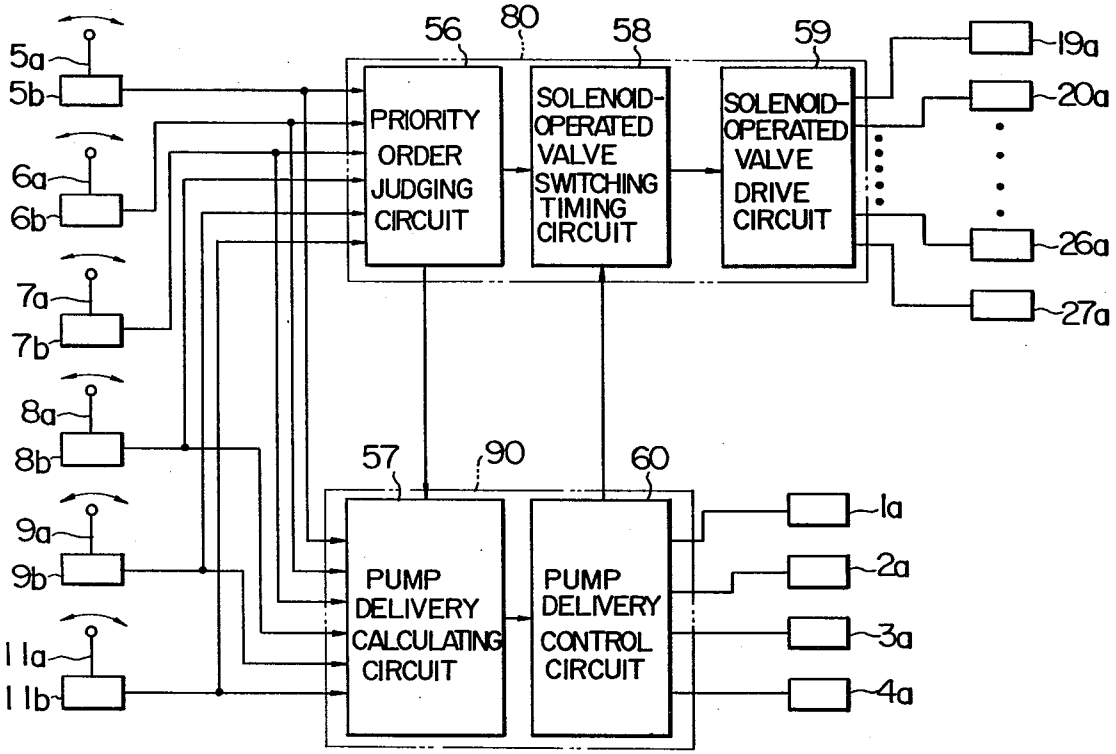
FIG. 5 is a block diagram of one embodiment of the control means according to the invention for controlling the hydraulic circuit means shown in FIG. 1.

FIG. 5 shows one embodiment of the control means for the hydraulic circuit means according to the invention. In FIG. 5, 1*a*–4*a* are the regulators for controlling the deliveries by Pumps 1–4 respectively shown in FIG. 1, and 19*a*–27*a* solenoids of the solenoid-operated valves 19–27 respectively. There are shown a boom control lever 5*a*, travelling control levers 6*a* and 7*a*, an arm control lever 8*a*, a bucket control lever 9*a* and a swivelling control lever 11*a*. All the control levers 5*a*–9*a* and 11*a* have connected thereto control lever stroke detectors 5*b*–9*b* and 11*b*, respectively, which may, for example be potentiometers. The output of each detector 5*b*–9*b*, 11*b* is transmitted to a priority order judging circuit 56 and a pump delivery calculating circuit 57. The judging circuit 56 is connected to solenoids 19*a*–27*a* via a solenoid-operated valve switching timing circuit 58 and a solenoid-operated valve driving circuit 59. The calculating circuit 57 is connected to regulators 1*a*–4*a* of pumps 1–4 via a pump delivery control circuit 60.

Judging circuit 56 judges the priority order for fluid communication between the hydraulic pumps and hydraulic actuators based on the control lever strokes. The calculating circuit 57 calculates pump deliveries based on the control lever strokes and the output of the judging circuit 56. The control circuit 60 controls the regulators 1*a*–4*a* of pumps 1–4 upon receipt of an output from the calculating circuit 57, to control the deliveries of pumps 1–4. The calculating circuit 57 and control circuit 60 constitute hydraulic pump control circuit means 90. The timing circuit 58 generates a command signal based on the result achieved by the judging circuit 56 and the information on the pump delivery supplied by the control circuit 60, and transmits such command signal to valves 19*a*–27*a* via the drive circuit 59 so as to switch valves 19*a*–27*a* with a timing that would minimize the shock produced by the switching of the solenoid-operated valves. The judging circuit 56, timing circuit 58 and drive circuit 59 constitute solenoid-operated valve control circuit means 80.

The operation of the control means shown in FIG. 5 will be described by referring to a dual operation of the machine wherein swivelling and arm operation are performed simultaneously.

Figure 6:
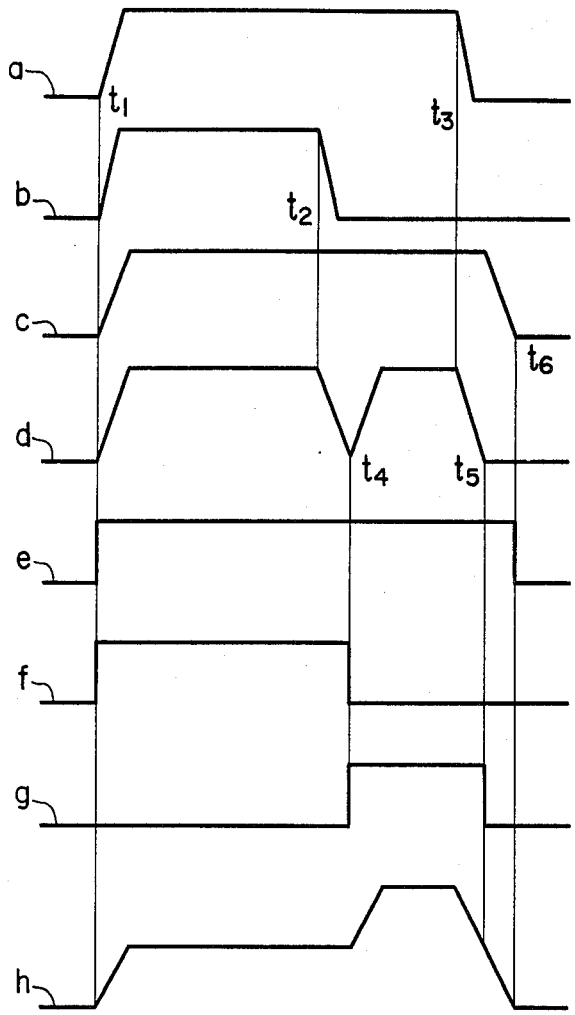
FIG. 6 is a time chart showing the operations of the elements of the hydraulic circuit means shown in FIG. 1 as they are controlled by the control means shown in FIG. 5.

FIG. 6 is a time chart of the aforesaid dual operation, wherein a designates the stroke of arm lever, b the stroke of swivelling lever, c the delivery by pump 2, d the delivery by pump 1, e a switching signal for valve 21, f a switching signal for valve 19, g a switching signal for valve 20 and h a speed of arm cylinder 8. The time chart shows operations wherein the arm control lever 8*a* and swivelling control lever 11*a* are fully pulled at time $t_1$, the swivelling control lever 11*a* alone is returned to a neutral position at time $t_2$ and the arm control lever 8*a* is returned to a neutral position at time $t_3$.

When the aforesaid operation is performed, valves 19 and 21 are energized at time $t_1$ to bring pump 1 and swivelling motor 11 into fluid communication with each other and to bring pump 2 and arm cylinder 8 into fluid communication with each other. At this time, the swivelling control lever 11*a* is also actuated even if the arm control lever 8*a* is at full stroke, so that the judging circuit 56 judges the order of priority of the swivelling motor 11 and arm cylinder 8 with respect to pump 1 and valve 20 is not energized. Thus, the flow of pressurized fluid from pump 1 to the arm cylinder 8 is blocked and the full-speed operation of the arm cylinder 8 is prevented. However, the swivelling control lever 11*a* is returned to its neutral position at time $t_2$, thereby enabling pressurized fluid to be supplied to the arm cylinder 8. If valve 19 is de-energized and valve 20 is energized at once at this time, the machine would suffer from the shock produced by sudden interruption of swivelling and sudden acceleration of arm operation. In order to avoid this trouble, the timing circuit 58 adjusts timing for energizing and de-energizing valves 19 and 20 in such a manner that switching of the valves is not effected until time $t_4$ at which the delivery of pump 1 is minimized or becomes zero. After valves 19 and 20 are switched, the delivery of pump 1 is controlled by the calculating circuit 57 and control circuit 60 and increases again, to thereby accelerate the movement of the arm cylinder 8 to the highest speed.

The arm control lever 8*a* is returned to its neutral position at time $t_3$ when the arm cylinder 8 is operating at full-speed. This reduces the delivery of pump 1, and valve 20 is de-energized at time $t_5$ when the delivery is minimized. Following this, the delivery of pump 2 shows a reduction, and valve 21 is de-energized at time $t_6$ when the delivery of pump 2 is minimized, to thereby render the arm cylinder 8 inoperative.

Figure 7:
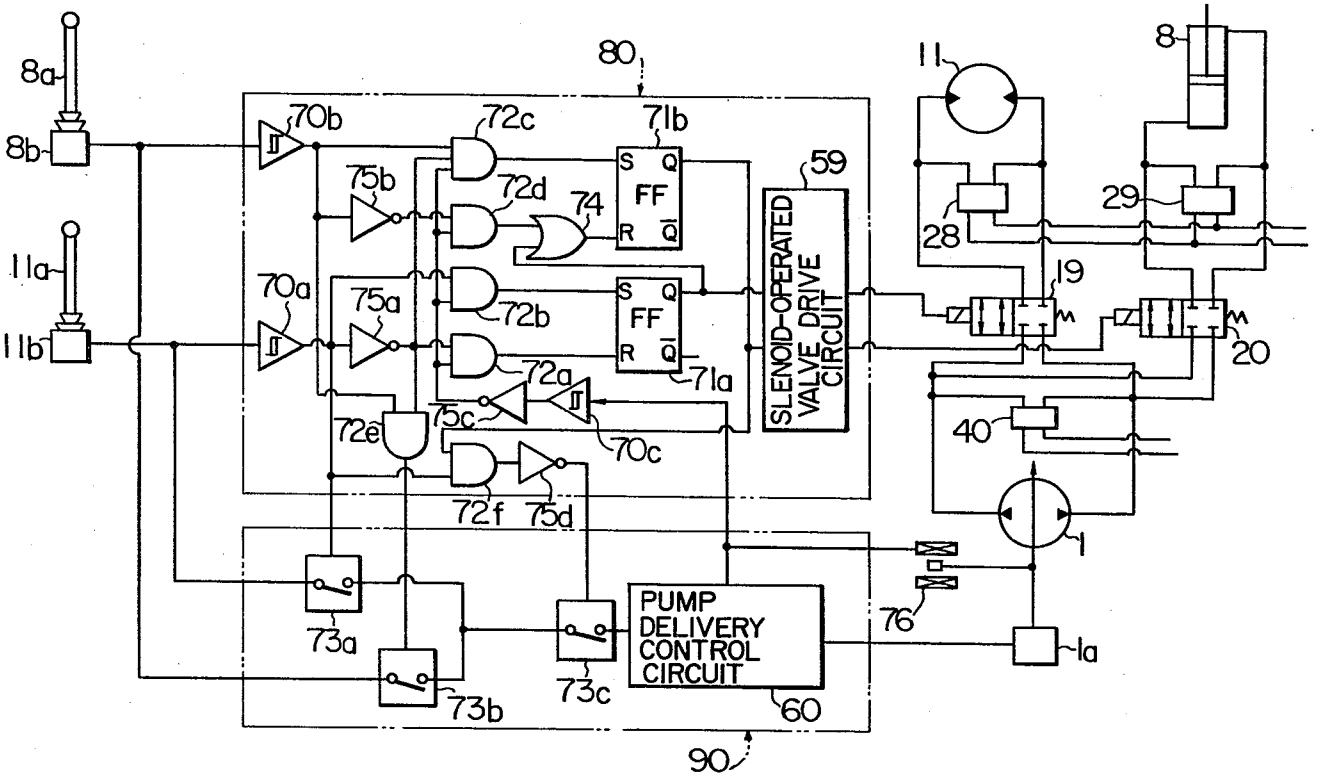
FIG. 7 is a circuit diagram of the control means shown in FIG. 5, showing the elements of the control means in concrete forms.

An example of the control means including the solenoid-operated valve control circuit means 80 and hydraulic pump control circuit means 90 described hereinabove will be described in detail by referring to FIG. 7 which shows the control means in concrete form. In FIG. 7, parts similar or corresponding to those shown in FIGS. 1 and 5 are designated by like reference characters.

In FIG. 7, there is shown an electronic device for judging the priority order of the swivelling motor 11 and arm cylinder 8 connected to the swashplate type variable-displacement pump 1 via the solenoid-operated valves 19 and 20, respectively, and relieving the shock that might otherwise be produced when valves 19 and 20 are switched. In the FIGS. 70*a* and 70*b* are window comparator circuits producing an output signal 0 when the absolute values of strokes of swivelling control lever 11*a* and arm control lever 8*a* or the command signals of the control lever stroke detectors 8*b* and 11*b* are below a predetermined value and producing an output signal 1 when the absolute values are above the predetermined value. 71*a* and 71*b* are flip-flop circuits, 72*a*–72*f* AND circuits and 73*a*–73*c* switching circuits. The switching circuits 73*a*–73*c* are closed when the command signals thereto are 1 and opened when they are 0. 74 is an OR circuit, and 75*a*–75*d* are NOT circuits. 76 is a displacement meter for detecting the swashplate angle position of pump 1, and 70*c* a window comparator circuit producing an output signal 0 when the output of the displacement meter 76 or the absolute value of the swashplate angle position of pump 1 is below a predetermined value and producing an output signal 1 when it is above the predetermined value.

In operation, when only the swivelling control lever 11*a* is actuated, the comparator circuit 70*a* produces an output signal 1, and the switching circuit 73*a* receives a command signal 1 and moves to a closed position. At the same time, the output signal 1 is also transmitted to AND circuit 72*b*. At this time, the swashplate of pump 1 is in a neutral position, so that the comparator circuit 70*c* produces an output 0 and the NOT circuit 75*c* produces an output 1. Thus the AND circuit 72*b* produces an output 1 which is inputted to an S terminal of the flip-flop circuit 71*a*. The flip-flop circuit 71*a* produces at a Q terminal an output 1 which switches valve 19 from a closed position to an open position. Although the output of the comparator circuit 70*a* is 1, the output produced at a Q terminal of the flip-flop circuit 71*b* is 0, so that the AND circuit 72*f* produces an output 0 and the NOT circuit 75*d* produces an output 1, so that the switching circuit 73*c* remains closed. As a result, the output signal of control lever 11*a* is transmitted to the pump delivery control circuit 60 and regulator 1*a* is actuated to control the swashplate of pump 1, to thereby control the speed and the direction of operation of motor 11.

When only the arm control lever 8*a* is actuated, the comparator circuit 70*b* produces an output signal 1 which is supplied to the AND circuit 72*e*. Since the control lever 11*a* is neutral at this time, the comparator circuit 70*a* produces an output 0 and the NOT circuit 75*a* produces an output 1, so that the AND circuit 72*e* receives two inputs 1, and produces an output 1 which closes the switching circuit 73*b*. Also, the output 0 of the comparator circuit 70*a* is inputted to the AND circuit 72*f*, so that the NOT circuit 75*d* produces an output 1 which closes the switching circuit 73*c*. Thus, it is possible to control pump 1 by means of the control lever 8*a*. Furthermore, since the comparator circuit 70*b* produces an output 1 and the NOT circuit 75*a* produces an output 1 while the swashplate of pump 1 is initially in the neutral position, the comparator circuit 70*a* produces an output signal 0 and the NOT circuit 75*c* produces an output 1. Therefore, the AND circuit 72*c* receives two inputs 1 and produces an output 1, and the AND circuit 72*c* produces an output 1, and the flip-flop circuit 71*b* produces at a Q terminal an output 1 which moves valve 20 to an open position. Thus, the arm cylinder 8 can be controlled by means of the control lever 8*a*.

When the two control levers 8*a* and 11*a* are simultaneously actuated, the NOT circuit 75*a* produces an output 0 and the AND circuit 72*e* produces an output 0, so that the switching circuit 73*b* is opened. The comparator circuit 70*a* produces an output 1, so that the switching circuit 73*a* is closed. The NOT circuit 75*a* produces an output 0, so that the AND circuit 72*c* produces an output 0. The flip-flop circuit 71*b* produces, at a Q terminal, an output 0 and the AND circuit 72*b* produces an output 1 while the flip-flop 71*a* produces at a Q terminal an output 1, so that valve 19 is opened. Thus, the hydraulic motor 11 can be controlled by means of the control lever 11*a*.

Let us assume that the control lever 11*a* is actuated while the hydraulic cylinder 8 is being operated by means of the arm control lever 8*a*. When this is the case, the comparator circuit 70*a* produces an output signal 1 which closes the switching circuit 73*a*. The NOT circuit 75*a* produces an output 0 and the AND circuit 72*e* produces an output 0, so that the switching circuit 73*b* is opened. Moreover, at the instant the swivelling control lever 11*a* is desired to be actuated, the swashplate of pump 1 is not in the neutral position, so that the output of the NOT circuit 75*c* remains 0 and the output at the Q terminal of flip-flop circuit 71*a* also remains 0. The output at the Q terminal of flip-flop circuit 71*b* is 1, so that the AND circuit 72*f* receives two inputs 1 and the NOT circuit 75*d* produces an output 0 which opens the switching circuit 73*c*. As a result, the swashplate of pump 1 is returned to the neutral position. This changes the output of comparator circuit 70*c* to 0 and the output of NOT circuit 76*c* to 1, so that the AND circuit 72*b* produces an output 1 and the flip-flop circuit 71*a* produces an output 1 at the Q terminal. Since the output of OR circuit 74 is changed to 1, the flip-flop circuit 71*b* produces an output 0 at the Q terminal. This switches valve 19 from the closed position to the open position and switches valve 20 from the open position to the closed position. Moreover, the output of AND circuit 72*f* is changed to 0 and the switching circuit 73*c* is closed, so that pump 1 can be controlled by means of the signal produced by the control lever 11*a*. The output of flip-flop circuit 71*a* produced at the Q terminal is inputted to the OR circuit 74, so that valve 19 is not moved to the open position without the flip-flop circuit 71*b* being reset.

Let us also assume that the control lever 8*a* is actuated when the hydraulic motor 11 is being controlled by means of the control lever 11*a*. When this is the case, the comparator circuit 70*b* produces an output 1. However, since the output of NOT circuit 75*a* remains 0, the outputs of AND circuits 72*e* and 72*c* also remain 0. Thus the switching circuit 73*b* remains open and the valve 20 is not switched, so that the hydraulic motor, high in the priority order, is continuously driven.

Thus, it will be appreciated that the solenoid-operated valve control circuit 80 and pump control circuit 90 operate such that if the actuator 11 high in the priority order is operated while the actuator 8 low in the priority order is being driven, then pump 1 has its swashplate angle position and hence its delivery controlled by the command signal of the actuator 11 high in the priority order and valves 19 and 20 are switched to enable only the actuator 11 to be driven. Switching of valves 19 and 20 is not effected until the delivery by pump 1 becomes substantially zero, so that sudden stopping and starting of the actuator 11 can be avoided to thereby enable the shock to be relieved and the operability to be increased.

The example has been described as being used for controlling the closed circuit of pump 1 and actuators 8 and 11. It is to be understood that the embodiment can effect similar control with regard to other closed circuits and when there are over three actuators involved in the operation. Also, the example has been described as using an electronic device, but it will be understood that a digital computer, such as microcomputer, may be used instead.

Figure 8:
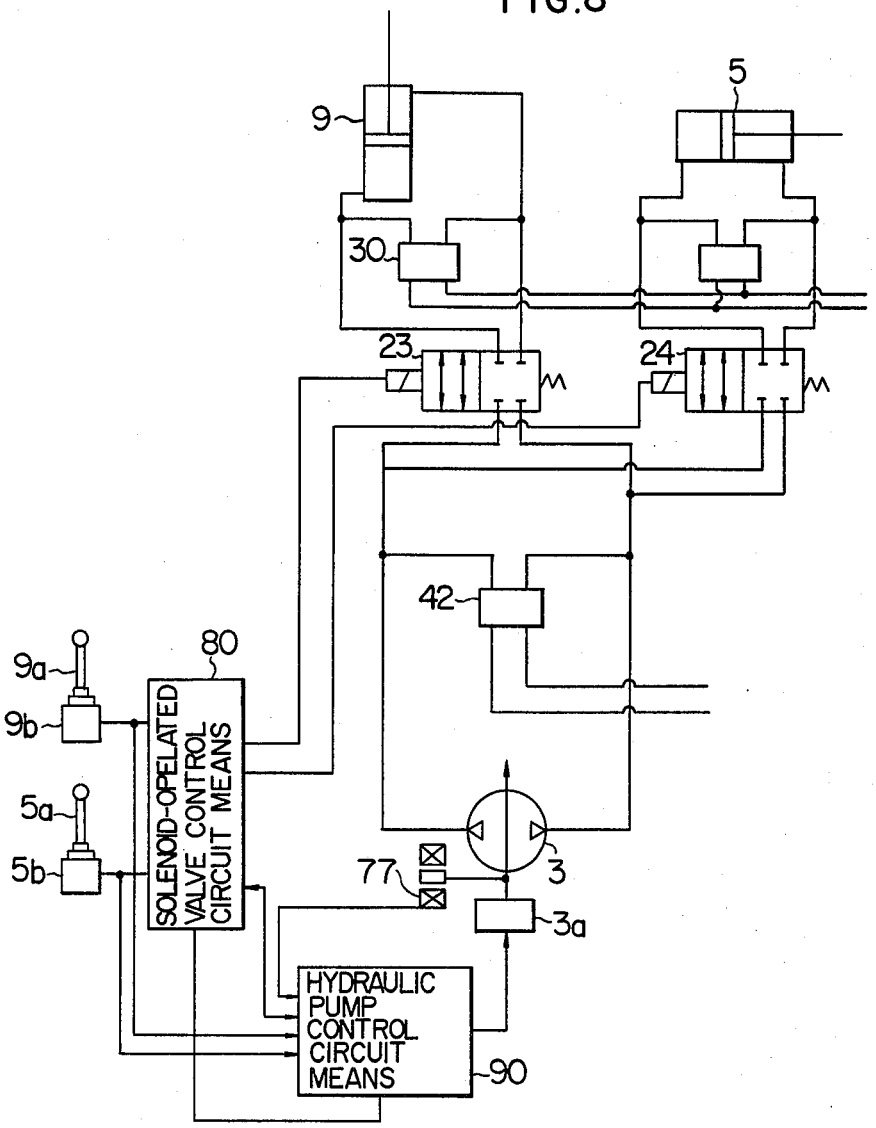
FIG. 8 is a block diagram of another embodiment of the control means according to the invention for controlling the hydraulic circuit means shown in FIG. 1.
Figure 12:
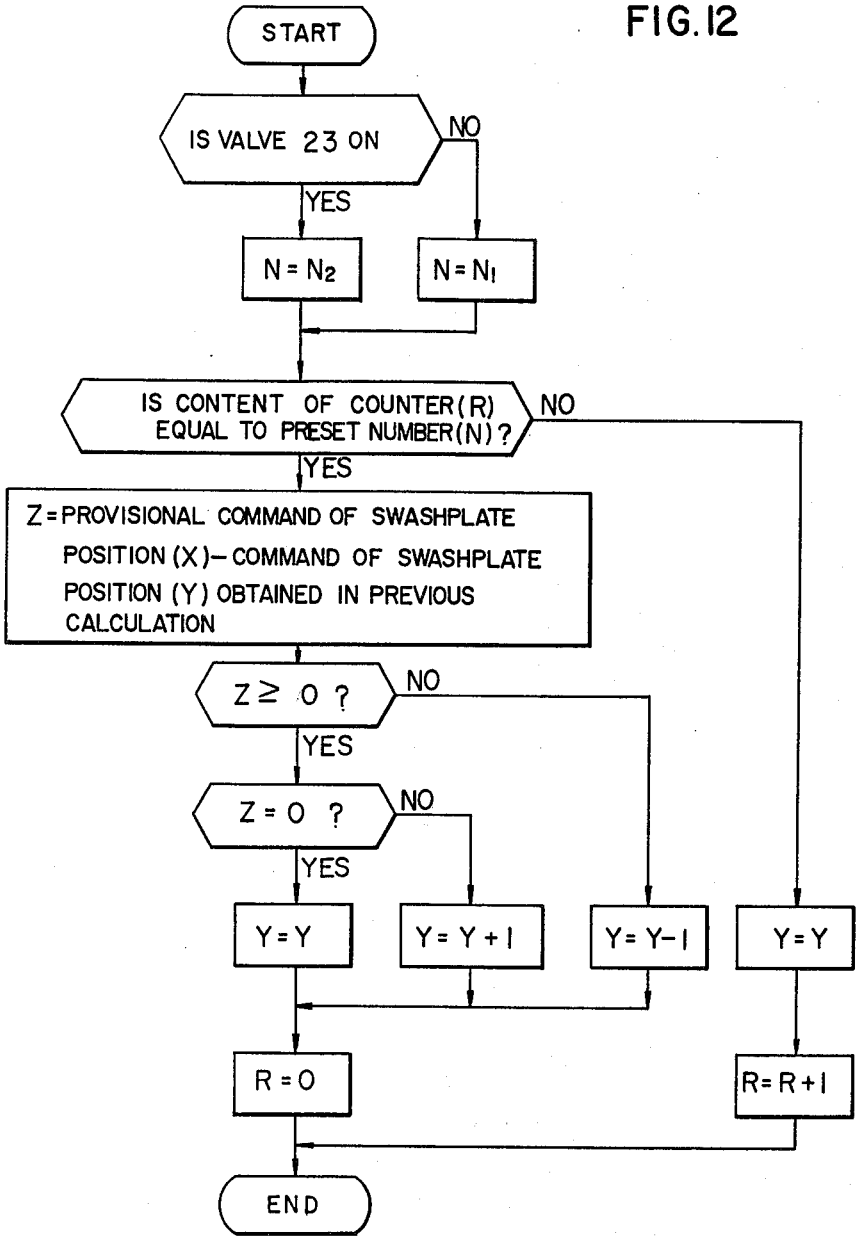
FIG. 12 is a flow chart showing another example of the operations for effecting swashplate maximum speed limit control shown in the flow chart of FIG. 9.

FIGS. 8 and 12 show another embodiment of the control means including the solenoid-operated valve control circuit means 80 and hydraulic pump control circuit means 90 which enables the movable member or members to operate with maximum efficiency without any shock when the operation speed of each hydraulic actuator is increased or decreased or when each actuator is started or stopped. More specifically, the operation speed of each actuator is altered in such a manner that the change in speed is in comformity with the inertia and operation characteristics of the movable member or members associated with the particular hydraulic actuator.

For example, the boom of a hydraulic shovel is high in inertia. If the operation speed of the actuator is suddenly altered when such movable member is started or stopped, the movable member will not operate smoothly and the machine will suffer a shock. On the other hand, a bucket is preferably operated at a relatively high acceleration in order to increase the efficiency of excavation because it is relatively low in inertia. However, it is not desirable to suddenly alter the operation speed of the bucket. The embodiment shown in FIGS. 8 and 12 is capable of optimizing the maximum acceleration and maximum deceleration of each hydraulic actuator.

FIG. 8 shows control means for hydraulic circuit means for driving the boom cylinder 5 and bucket cylinder 9 by means of pump 3. The control means shown effects control of the highest changing rate of the delivery by pump 3 to optimize the maximum acceleration and maximum deceleration of the bucket cylinder 9 and boom cylinder 5, in addition to the control of timing for switching the solenoid-operated valves. In the embodiment shown, pump 3 is a swashplate pump, so that the maximum value of the speed for tilting the swashplate is controlled.

More specifically, the control circuit means 80 judges the order of priority for bringing cylinders 5 and 9 into fluid communication with pump 3, and supplies a switching signal to valves 23 and 24 based on the result of judgment. In the embodiment shown, the bucket cylinder 9 is higher in the priority order than the boom cylinder 5 with respect to pump 3. The control circuit means 90 calculates the swashplate tilting speed suitable for cylinders 5 and 9 based on the outputs of control lever stroke detectors 5*b* and 9*b*, control circuit 80 and a displacement meter 77 and supplies the result of calculations to the regulator or swashplate angle position control means 3*a*. The solenoid-operated valve control circuit means 80 and hydraulic pump control circuit means 90, which are preferably in the form of a microcomputer, do calculations in accordance with the flow charts shown in FIGS. 9 and 10.

The method of control, carried into effect by using the embodiment described hereinabove, will now be described by referring to the flow charts for performing calculations shown on FIGS. 9 and 10 and the time chart shown in FIG. 11.

The operations of pump 3 and valves 23 and 24 which will be performed when the control method according to the invention is carried into practice will first be described by referring to the time chart shown in FIG. 11. In FIG. 11, A designates the stroke of boom control lever 5*a*, B the stroke of bucket control lever 9*a*, C the swashplate angle position of pump 3, D the ON signal of valve 24, and E the ON signal of valve 23. The time chart shows the operations for pulling the control lever 5*a* at time $t_1$ from neutral to maximum control lever stroke in a short period of time, pulling the control lever 9*a* at time $t_2$ from neutral to maximum control lever stroke in a short period of time, returning the control lever 9a to a neutral position at time $t_3$ in a short period of time, and returning the control lever 5a to a neutral position at time $t_4$ in a short period of time.

Prior to commencement of control at time $t_1$, control levers 5a and 9a are both in neutral positions, so that the swashplate of pump 3 is in a neutral position (See C) and valves 23 and 24 are in OFF positions (See D and E).

If control lever 5a is suddenly pulled to the maximum lever stroke at time $t_1$, then valve 24 is switched to an ON position to bring pump 3 and boom cylinder 5 into fluid communication with each other. And the swashplate angle position of pump 3 increases at a maximum speed in conformity with the operation of boom cylinder 5. At this time, the swashplate tilting speed of pump 3 is in conformity with the acceleration of boom cylinder 5. Since the load driven by the boom cylinder 5 has high inertia, the maximum value of the swashplate tilting speed is set at a low level. Thus, the acceleration of boom cylinder 5 is optimized even if control lever 5a is suddenly actuated.

Then, if control lever 9a is actuated at time $t_2$, the boom cylinder 5 is released from fluid communication with pump 3 and the bucket cylinder 9 is brought into fluid communication therewith because bucket cylinder 9 is higher in priority order than boom cylinder 5 with respect to pump 3. However, sudden hydraulic communication of pump 3 from boom cylinder 5 to bucket cylinder 9 produces shock in the machine. To avoid this trouble, the swashplate angle position of pump 3 is reduced and the swashplate is returned to a neutral position while valve 24 is being kept in ON position. At this time, pump 3 has its swashplate returned to the neutral position at a swashplate tilting speed corresponding to an optimum deceleration of the boom cylinder 5 so that the speed of reduction of swashplate tilting matches the deceleration of the boom cylinder 5, as when the boom cylinder 5 is accelerated. Following restoration of the swashplate to the neutral position, valve 24 is switched to an OFF position and valve 23 is switched to an ON position, to bring pump 3 into fluid communication with bucket cylinder 9. Then the swashplate angle position of pump 3 is increased to accelerate the bucket cylinder 9. At this time, the optimum maximum swashplate tilting speed differs from that used when the boom cylinder 5 is accelerated. That is, the load has lower inertia when bucket cylinder 9 is driven than when boom cylinder 5 is driven, so that it is possible to set the maximum swashplate tilting speed for bucket cylinder 9 at a higher level. At time $t_3$, control lever 9a is suddenly returned to a neutral position. At this time, the swashplate angle reducing speed of pump 3 is connected to an optimum maximum value in conformity with the deceleration of bucket cylinder 9. When the swashplate of pump 3 has returned to the neutral position, control lever 5a is in the pulled position, so that valve 23 is switched to the OFF position and valve 24 is switched to the ON position. This brings boom cylinder 5 into fluid communication with pump 3 again, so that the boom cylinder 5 is accelerated at an optimum rate. When control lever 5a is suddenly returned to a neutral position at time $t_4$, the boom cylinder 5 is decelerated at an optimum rate, and valve 24 is switched to the OFF position after pump 3 has returned to the neutral position.

The operations of pump 3 and valves 23 and 24 performed when the control method according to the invention is applied to the drive system for construction machinery have been described by referring to sudden actuation of control levers 5a and 9a. It is to be understood that when actuation of control levers 5a and 9a is effected slowly, the swashplate angle position of pump 3 undergoes slow changes following the strokes of control levers 5a and 9a.

The method of control enabling the aforesaid operations to be performed will now be described by referring to the flow charts shown in FIGS. 9 and 10. In FIG. 9, the routine shown on the right side is similar to the routine shown on the left side except that swashplate tilting is effected by turning on valve 24 in the step surrounded by broken lines.

Figure 11:
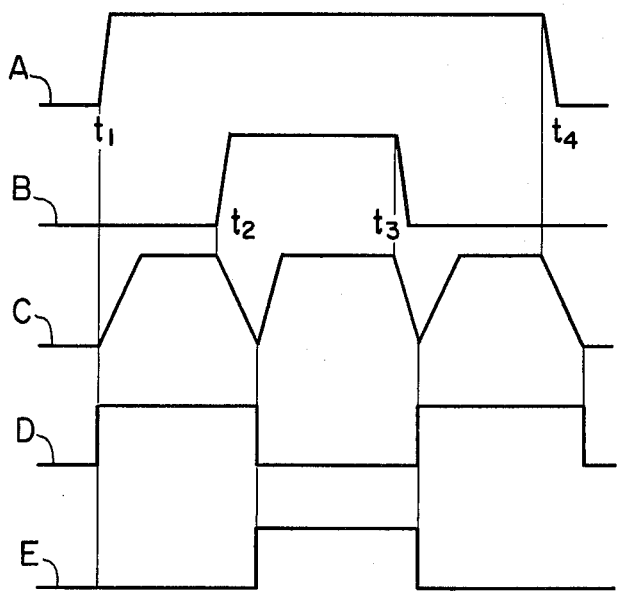
FIG. 11 is a time chart showing the operations of the elements of the hydraulic circuit means shown in FIG. 1 as they operate as shown in FIGS. 9 and 10.

The control levers 5a and 9a are both in neutral positions before commencement of control prior to time $t_1$ shown in FIG. 11, so that the solenoid-operated valve control circuit means 80 and hydraulic pump control circuit means 90 commence calculations according to the routine on the left side. First, initial setting of the routine is carried out. In the control method according to the invention, switching of valves 23 and 24 is effected after the swashplate of pump 3 is returned to its neutral position as aforesaid. Because of this, the step of judging the swashplate being in neutral position comes later, and a swashplate neutral judging completion flag is set up when the swashplate has moved to its neutral position. The initial setting indicates that the swashplate neutral judging completion flag is cleared when the operations have shifted from the routine on the right side to the routine on the left side. When the routine on the left side is followed repeatedly, this step is skipped.

The next step concerns judging whether or not the swashplate is in its neutral position. The swashplate is neutral prior to time $t_1$ shown in FIG. 11, so that the swashplate neutral judging completion flag is set up. Then the swashplate is judged as to whether it is neutral again. Since the swashplate is naturally neutral, a signal is produced to bring valves 23 and 24 to OFF positions. This brings pump 3 out of fluid communication with both boom cylinder 5 and bucket cylinder 9. Thereafter a provisional command of swashplate angle position corresponding to the stroke of control lever 5a is produced. However, since control lever 5a is neutral, a command of swashplate angle position zero is transmitted to swashplate control means 3a via a swashplate maximum speed limit control. This series of calculations is performed repeatedly once for each sampling time $\Delta T$.

Figure 9:
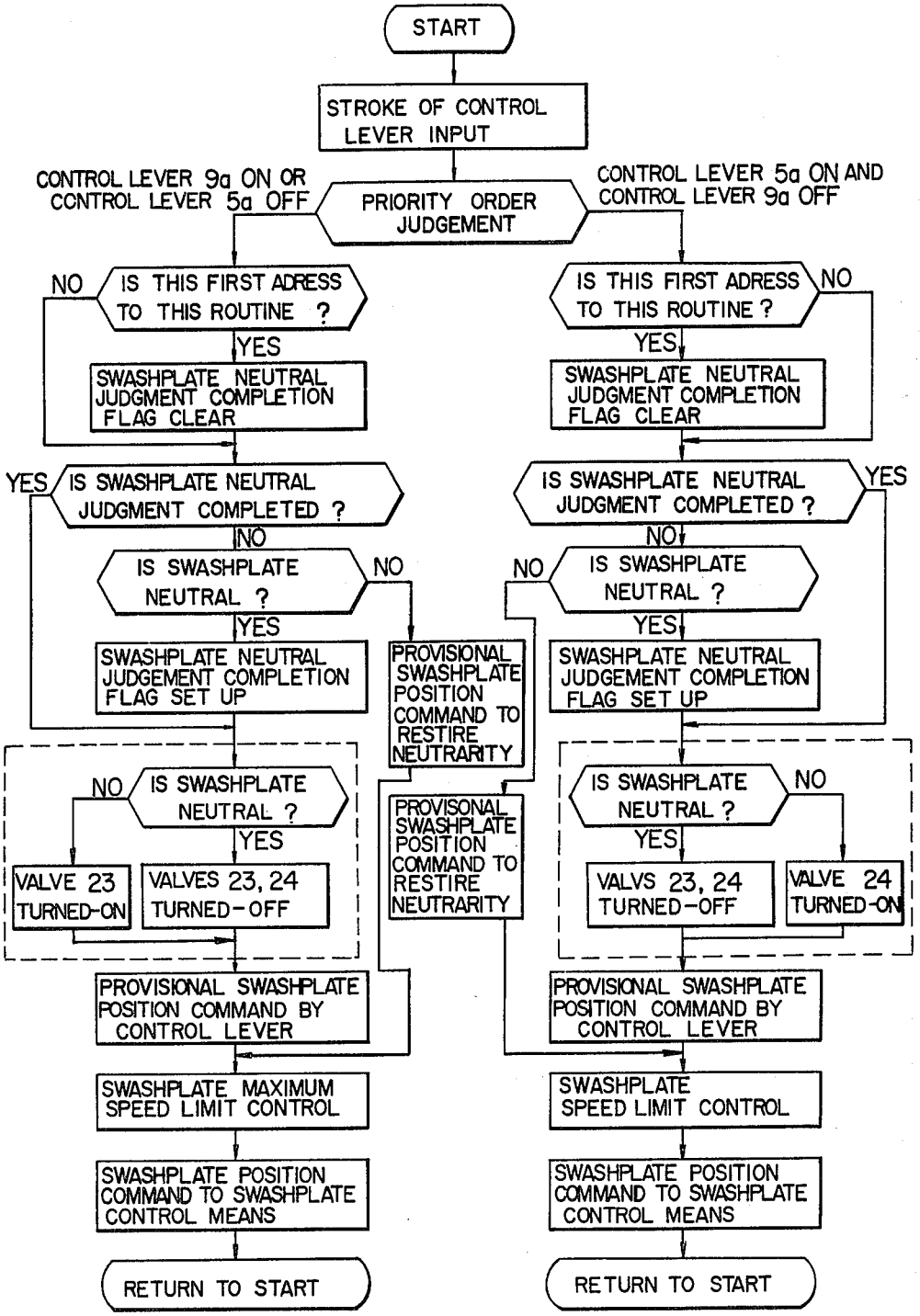
FIG. 9 is a flow chart of the operations performed by the solenoid-operated valve control circuit means and the hydraulic pump control circuit means shown in FIG. 8.

When control lever 5a is moved suddenly at time $t_1$ shown in FIG. 11 from neutral to the maximum stroke of control lever, then calculations are performed by following the routine on the right side in FIG. 9 in accordance with a judgement passed on priority order. That is, the steps of initial setting of the routine and judging of swashplate neutral are followed to transmit a signal to valve 24 to switch same to an ON position. Then the stroke of control lever 5a is transmitted in the form of a provisional command of swashplate angle position X to the swashplate maximum speed limit control in the routine. Calculations are done by the swashplate maximum speed limit control in accordance with the flow chart shown in FIG. 10.

The aforesaid provisional command of swashplate angle position X based on the stroke of control lever 5a is compared with a command of swashplate angle position Y transmitted to the swashplate control means 3a as a result of a calculation done once previously, to determine the difference Z ($=X-Y$). Meanwhile the position of valve 23 is judged to select an optimized maximum increase $\Delta Y$ of the swashplate angle position per unit sampling time. That is, an optimum value $\Delta Y_2$ for bucket cylinder 9 is selected by optimizing the maximum increase $\Delta Y$ when valve 23 is in the ON position, and $\Delta Y$ is selected as an optimum value $\Delta Y_1$ for boom cylinder 5 when valve 23 is not in the ON position. Since valve 23 is now in the OFF position, $\Delta Y_1$ is selected and used as an optimized maximum increase $\Delta Y$. Then this optimized maximum increase $\Delta Y$ is compared with the absolute value of the difference Z obtained by calculation beforehand. When $|Z| \leqq \Delta Y$, the provisional command of swashplate angle position X is transmitted as a command of swashplate angle position Y to swashplate control means 3*a*. When $|Z| > \Delta Y$, then Z is judged as to whether it is positive or negative. When $Z > 0$, $\Delta Y$ is added to the command of swashplate angle position Y transmitted to the swashplate control means 3*a* as a result of the calculation performed once previously so that a new command of swashplate angle position Y is transmitted to the swashplate control means 3*a*. Also, when $Z < 0$, $Y = Y - \Delta Y$ is calculated and a new command of swashplate angle position Y is transmitted to the swashplate control means 3*a*. In the example shown in the time chart of FIG. 11, control lever 5*a* is suddenly actuated at time $t_1$, so that $|Z| > \Delta Y$ and $Z > 0$, Thus, the new command of swashplate angle position Y is the command of swashplate angle position Y calculated once previously plus an optimized maximum increase $\Delta Y = \Delta Y_1$. This calculation is done once per unit sampling time $\Delta T$, so that the swashplate angle position of pump 3 increases by $\Delta Y_1$ for each sampling time $\Delta T$. Therefore, the swashplate maximum tilting speed is limited to $\Delta Y_1/\Delta T$. And when $Z = 0$ or when the provisional command of swashplate angle position X based on the stroke of the control lever agrees with the command of swashplate angle position Y transmitted to the swashplate control means 3*a*, the swashplate angle position is kept constant.

When the control lever 9*a* is actuated at time $t_2$ in the time chart shown in FIG. 11, the calculations are done following the routine on the left side in FIG. 9 in accordance with a judgment passed on priority order. Initial setting is done and then the swashplate is judged as to whether or not it is neutral. Since the swashplate angle position is maximized and not neutral now, a provisional command of swashplate angle position $X = 0$ is transmitted to the swashplate maximum speed limit control. At this time, valve 24 is still in the ON position and valve 23 is in the OFF position, so that a value $\Delta Y_1$ for boom cylinder 5 is selected as an optimized maximum increase $\Delta Y$ in accordance with the swashplate maximum speed limit control routine shown in FIG. 10. Since $|Z| > \Delta Y$ and $Z < 0$, $Y = Y - \Delta Y$ is calculated to transmit a command of swashplate angle position Y to the swashplate control means 3*a*. As aforesaid, this processing is done once for each sampling time $\Delta T$, so that the swashplate angle position of pump 3 is reduced by $\Delta Y_1$ for each time $\Delta T$. Thus the swashplate tilting speed is limited to $-\Delta Y_1/\Delta T$ at this time. When $Z = 0$ or when the swashplate becomes neutral, the swashplate neutral judging completion flag is set up and valve 24 is returned to the OFF position. Then a provisional command of swashplate angle position X is transmitted by the control lever 9*a* to the swashplate maximum speed limit control.

The swashplate maximum speed limit control shown in FIG. 10 calculates $Z = X - Y$ according to the routine as described hereinabove, and then judges the position of valve 23. At this time, valve 23 has not been switched to the ON position yet, so that $\Delta Y_1$ is tentatively selected as an optimized maximum increase $\Delta Y$ of swashplate angle position, and a command of swashplate angle position $Y = \Delta Y_1$ is transmitted to the swashplate control means 3*a* via the channels of $|Z| > \Delta Y$ and $Z > 0$. The next following calculation cycle shifts to the step surrounded by broken lines of the routine on the left side in FIG. 9 by skipping initial setting and neutral judging completion.

The swashplate is judged anew as to whether or not it is neutral. However, since the signal $Y = \Delta Y_1$ has been produced in the previous cycle, the swashplate is not neutral, so that a signal for switching valve 23 to an ON position is produced to bring the bucket cylinder 9 into fluid communication with pump 3. The stroke of control lever 9*a* is transmitted as a provisional command of swashplate angle position X to the swashplate maximum speed limit control.

The swashplate maximum speed limit control shown in FIG. 10 calculates the difference Z in accordance with the routine as described hereinabove. Then a value $\Delta Y_2$ set for the bucket cylinder 9 is selected as an optimized maximum increase $\Delta Y$ of the swashplate angle position, because valve 23 has already been switched to an ON position. Thereafter $Y = Y + \Delta Y$ is calculated via the channels of $|Z| > \Delta Y$ and $Z < 0$, to transmit a command of swashplate angle position Y to the swashplate control means 3*a*. Thus, the command of swashplate angle position for pump 3 is increased by $\Delta Y_2$ for each calculation cycle thereafter and the swashplate tilting speed is limited to $\Delta Y_2/\Delta T$. If $\Delta Y_2 > \Delta Y_1$ as set beforehand, then the swashplate tilting speed becomes higher than when the boom cylinder 5 is actuated. And the command of swashplate angle position for pump 3 is increased until $Z = 0$ or the command of swashplate angle position Y becomes equal to the provisional command of swashplate angle position X based on the stroke of control lever 9*a*, as is the case with acceleration of the boom cylinder 5.

When the control lever 9*a* is suddenly brought to neutral at time $t_3$, the calculations again shift to the routine on the right side in FIG. 9 in accordance with the judging of priority order. At this time, initial setting and swashplate neutral judging are performed. However, since the command of swashplate angle position Y for pump 3 is maximized, $X = 0$ is transmitted as a provisional command of swashplate angle position to the swashplate maximum speed limit control, to restore a neutral position to the swashplate. In this control, control is effected according to the routine in the same manner as a neutral position has been restored to the swashplate at time $t_2$. However, since valve 23 has already been switched to an ON position, $\Delta Y_2$ is selected as an optimized maximum increase $\Delta Y$ of the command of swashplate angle position, and the swashplate tilting speed is controlled to $-\Delta Y_2/\Delta T$.

When a neutral position is restored to the swashplate of pump 3, a swashplate neutral judging completion flag is set up, and then valve 23 is switched to an OFF position. Thereafter a provisional command of swashplate angle position X based on the stroke of control lever 5*a* is transmitted to the swashplate maximum speed limit control, and a value $\Delta Y_1$ set for the boom cylinder 5 is selected again as an optimum maximum increase $\Delta Y$ of the command of swashplate angle position. And a command of swashplate angle position $Y = \Delta Y_1$ is transmitted to the swashplate control means 3a through the channels of $|Z|>\Delta Y$ and $Z>0$. In the next following calculation cycle, the initial setting and swashplate neutral judging of the routine on the right side in FIG. 9 are skipped and the step surrounded by broken lines is followed to switch valve 24 to an ON position and bring boom cylinder 5 into fluid communication with pump 3. Thereafter the command of swashplate angle position is increased by controlling the swashplate tilting speed to $\Delta Y_1/\Delta T$ in the same manner as boom cylinder 5 has been accelerated at time $t_1$. When the control lever 5a is suddenly returned to the neutral position at time $t_4$, the calculations transfer to the routine on the left side in accordance with the judging of priority order shown in the flow chart of FIG. 9. In this case also, initial setting and swashplate neutral judging are carried out, and $X=0$ is produced as a provisional command of swashplate angle position and transmitted to the swashplate maximum speed limit control, to return the swashplate to the neutral position. Since valve 23 is in the OFF position at this time, $\Delta Y_1$ is selected as an optimized maximum increase $\Delta Y$, and the command of swashplate angle position is reduced to neutral through the channels of $|Z|>\Delta Y$ and $Z<0$ while controlling the swashplate tilting speed to $-\Delta Y_1/\Delta T$. Upon a neutral position being restored to the swashplate of pump 3, valve 24 is switched to an OFF position and boom cylinder 5 is brought out of fluid communication with pump 3.

In the embodiment described hereinabove, $\Delta T$ is kept constant and $\Delta Y$ is varied to adjust the maximum value $\Delta Y/\Delta T$ of swashplate tilting speed. It is to be understood that $\Delta Y$ may be kept constant as an unit increment and $\Delta T$ may be varied. When this is the case, lapse of time can be judged by the number of calculation cycles. More specifically, by using a counter which is added with 1 each time one calculation is done, it can be seen that the time $\Delta T=R\cdot\Delta t$ has elapsed when the content of the counter has become R. Here $\Delta t$ is a cycle time for calculation. Thus, if the content of the counter is compared with a predetermined numeral N and the command of swashplate angle position Y is increased or decreased when $R=N$, then it is possible to control the maximum value of swashplate tilting speed. Swashplate maximum speed limit control based on the aforesaid concept is shown in the flow chart in FIG. 12.

Figure 10:
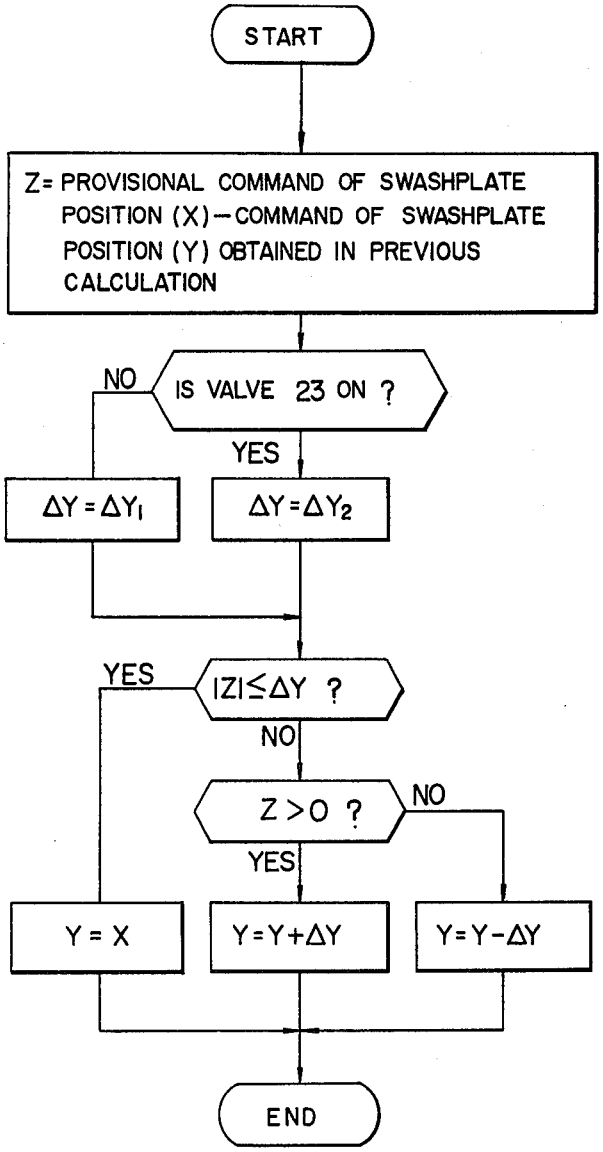
FIG. 10 is a flow chart showing in detail one example of the operations for effecting swashplate maximum speed limit control shown in the flow chart of FIG. 9.

In the embodiment shown in the flow chart of FIG. 10, two optimum maximum increases $\Delta Y$ of swashplate angle position are provided to correspond to the two positions of valve 23. In the embodiment shown in FIG. 12, two numerals N to be compared with the content R of the counter are provided to correspond to the two positions of valve 23. That is, the timing for increasing the command of swashplate angle position is $\Delta T_1=N_1\Delta t$ when valve 23 is in the ON position, and is $\Delta T_2=N_2\Delta t$ when valve 23 is in the OFF position. Consequently, by setting $N_1>N_2$, the swashplate maximum tilting speed of pump 3 is lower when boom cylinder 5 is brought into fluid communication with pump 3 than when bucket cylinder 11 is brought into fluid communication therewith.

In the aforesaid embodiment, two hydraulic actuators are brought into fluid communication with one hydraulic pump via two solenoid-operated valves. It is to be understood that a plurality of hydraulic actuators may be brought into fluid communication with a plurality of hydraulic pumps via solenoid-operated valves.

From the foregoing description, it will be appreciated that the method and means of controlling the hydraulic circuit means of the drive system according to the invention enable the maximum speed of swashplate tilting of a hydraulic pump or the maximum changing rate of the delivery thereof to be controlled in conformity with an acceleration suitable for each hydraulic actuator. This is conductive to the prevention of a high hydraulic pressure from being produced in each hydraulic actuator when an associated control lever is suddenly actuated. As a result, it is possible to minimize production of shock when operation of a movable member of high inertia is started or ceased and at the same time to maximize the performance of each movable member driven by one of the hydraulic actuators. Thus the operability of each movable member can be increased.

What is claimed is:

1. A drive system for construction machinery comprising hydraulic circuit means including a plurality of variable-displacement hydraulic pumps, a plurality of hydraulic actuator means driven independently and separately from one another by said pumps, at least one of said pumps being connected in closed circuit to at least two of said actuator means through solenoid-operated valve means to drive at least one movable member connected to the actuator means when pressurized fluid is supplied to the actuator means from the pump, characterized in that at least one of a selected hydraulic actuator means is further connected in closed circuit through a solenoid-operated valve means to at least one of the hydraulic pumps other than the hydraulic pump which is connected in closed circuit to the selected hydraulic actuator means, and in that control means are provided for controlling the pumps and valve means including preprogrammed priority order judging means setting a preprogrammed priority order of hydraulic communication between each hydraulic pump and hydraulic actuator means to which the hydraulic pump is connected in closed circuit in dependence upon operation controlled command signals generated by operating means of the hydraulic circuit means.

2. A drive system as claimed in claim 1, wherein each said solenoid-operated valve means comprises an on-off valve.

3. A drive system for construction machinery comprising hydraulic circuit means including a plurality of variable-displacement hydraulic pumps and a plurality of hydraulic actuators, each of said pumps being connected in closed circuit to one or a plurality of said actuators through a solenoid-operated valve or valves to drive a movable member or members connected to the actuator or respective actuators when pressurized fluid is supplied to the actuator or actuators from the pump, characterized in that at least one of the selected hydraulic actuators is further connected in closed circuit through a solenoid operated valve to at least one of the hydraulic pumps other than the hydraulic pump which is connected in closed circuit to the selected hydraulic actuator, operator controlled means are provided for generating command signals, and in that preprogrammed control means are provided for controlling said pumps and valves setting a priority order of hydraulic commuication between each hydraulic pump and the hydraulic actuators to which said hydraulic pump is connected in closed circuit through the respective solenoid-operated valves, for closing all of said solenoid-operated valves when no command signals for driving said actuators are produced, for, when a command signal for driving at least one actuator is produced, opening the solenoid-operated valve associated with said one actuator or the actuator higher in the priority order to hydraulic communication with said hydraulic pump while controlling the delivery of the pump by the command signal for driving the actuator with which said opened valve is associated, for, when at least one of command signals which have been produced to drive at least one actuator is removed, closing the solenoid-operated valve associated with the actuator which have been driven by the removed command signal and/or opening or keeping open the solenoid-operated valve associated with the other actuator or actuator higher in the priority order of hydraulic communication with said hydraulic pump among the other actuators while controlling the delivery of the pump by the command signal for driving the actuator with which said opening or opening-kept valve is associated, and for conducting any switching of each solenoid-operatee valve only when the delivery of said pump is zero or has been reduced substantially to zero.

4. A drive system as claimed in claim 3, wherein said control means comprises solenoid-operated valve control circuit means and hydraulic pump control circuit means, said valve control circuit means including a priority order judging circuit for judging the priority order of hydraulic communication between each hydraulic pump and the hydraulic actuators to which said pump is connected in closed circuit on the basis of command signals for driving the hydraulic actuators, a solenoid-operated valve switching timing circuit for determining the timing of switching the solenoid-operated valves on the basis of the result of judging by said priority order judging circuit and the information on the delivery of said hydraulic pump, and a solenoid-operated valve drive circuit for driving the solenoid-operated valves on the basis of the output of the switching timing circuit, and said pump control circuit means including a pump delivery calculating circuit for determining the delivery of said hydraulic pump on the basis of command signals for driving the hydraulic actuators and the result of judging by said priority order judging circuit, a pump delivery control circuit for adjusting the change rate of the delivery of said hydraulic pump on the basis of the output of the pump delivery calculating circuit.

5. A drive system as claimed in claim 3, wherein said control means is further operative, when a command signal for increasing or reducing the operation speed of any one of said hydraulic actuators is produced, to judge for each sampling time $\Delta T$ whether or not a changing rate of the delivery of said pump is in the range of an optimized highest changing rate preset in conformity with the operation of said actuator, and to alter the changing rate of the delivery of the pump to the preset optimized highest changing rate when the former changing rate is judged to be higher than the latter changing rate, thereby adjusting the changing rate of the delivery of each pump so as to remain in the range of the optimized highest changing rate at all times.

6. A drive system as claimed in claim 5, wherein said control means is adapted to adjust the changing rate of the delivery of each pump with said sampling time $\Delta T$ being constant and the optimized maximum change $\Delta Y$ in the delivery of the pump being varied for each said actuator.

7. A drive system as claimed in claim 5, wherein said control means is adapted to adjust the changing rate rate of the delivery of each pump with said sampling time $\Delta T$ being varied for each said actuator and the maximum change $\Delta Y$ in the delivery of the pump being constant.

8. A method of controlling hydraulic circuit means of a drive system for construction machinery in which said hydraulic circuit means includes a plurality of variable-displacement hydraulic pumps and a plurality of hydraulic actuators, each said pump being connected in closed circuit to one or a plurality of said actuators through a solenoid-operated valve or valves to drive a movable member or members connected to the actuator or respective actuators when pressurized fluid is supplied to the actuator or actuators from the pump, at least one of the selected hydraulic actuators being further connected in closed circuit through a solenoid-operated valve to at least one of the hydraulic pumps other than the hydraulic pump which is connected in closed circuit to the selected hydraulic actuator, characterized in that said method comprises the steps of: setting a preprogrammed priority order of hydraulic communication between each hydraulic pump and the hydraulic actuators to which said hydraulic pump is connected in closed circuit through the respective solenoid-operated valves generating command signals by an operator; closing all of said solenoid-operated valves when no command signals for driving said actuators are produced; when a command signal for driving at least one actuator is produced, opening the solenoid-operated valve associated with said one actuator or the actuator higher in the priority order of hydraulic communication with said hydraulic pump while controlling the delivery of the pump by the command signal for driving the actuator with which said opened valve is associated; when at least one of command signals which have been produced to drive at least one actuator is removed, closing the solenoid-operated valve associated with the actuator which have been driven by the removed command signal and/or opening or keeping open the solenoid-operated valve associated with the other actuator or actuator higher in the priority order of hydraulic communication with said hydraulic pump among the other actuators while controlling the delivery of the pump by the command signal for driving the actuator with which said opened or opening-kept valve is associated; and conducting any switching of each said solenoid-operated valve only when the delivery of said pump is zero or has been reduced substantially to zero.

9. A method of control as claimed in claim 8, wherein said method further comprises the steps of, when a command signal for increasing or reducing the operation speed of any one of said hydraulic actuators is produced, judging for each sampling time $\Delta T$ whether or not a changing rate of the delivery of said pump is in the range of an optimized highest changing rate preset in conformity with the operation of said actuator, and altering the changing rate of the delivery of the pump to the preset optimized highest changing rate when the former changing rate is judged to be higher than the latter changing rate, thereby adjusting the changing rate of the delivery of each pump so as to remain in the range of the optimized highest changing rate at all times.

10. A method of control as claimed in claim 9, wherein said changing rate of the delivery of each pump is adjusted with said sampling time $\Delta T$ being constant and the optimized maximum change $\Delta Y$ in the delivery of the pump being varied for each said actuator.

11. A method of control as claimed in claim 9, wherein said changing rate of the delivery of each pump is adjusted with said sampling time $\Delta T$ being varied for each said actuator and the maximum change $\Delta Y$ in the delivery of the pump being constant.

12. A drive system for construction machinery comprising:

hydraulic circuit means including a plurality of reversible variable-displacement hydraulic pumps, a plurality of hydraulic actuator units driven independently and separately from each other by said pumps, said plurality of pumps being less in number than said plurality of actuator units, at least one of said plurality of pumps being connected to at least two of said plurality of actuator units to respectively form closed-circuits, at least one of said plurality of actuator units being connected to at least two of said plurality of pumps to respectively form closed circuits, and a plurality of solenoid-operated valves each incorporated in each of said closed circuits and operative such that each pump is brought into hydraulic communication with only one actuator unit at a time;

a plurality of manually operated means corresponding to said plurality of actuator units for generating command signals for driving the respective actuator units; and control means responsive to said command signals for controlling said pumps and valves such that each actuator unit is driven based on only a command signal generated by the corresponding manually operated means, said control means including preprogrammed priority order judging means determining a priority order of said at least two actuator units with respect to a hydraulic communication between said actuator units and said pump connected thereto forming the respective closed circuits, means for controlling said solenoid-operated valves such that a solenoid operated valve associated with the actuator unit selected by said priority order judging means is switched based on a command signal generated by the manually operated means corresponding to the selected actuator unit, and means for controlling said pumps such that a pump connected to said selected actuator unit forming the closed circuit is regulated based on said command signal generated by the manually operated means corresponding to the selected actuator unit to provide a delivery of hydraulic fluid in proportion to said command signal.

13. A drive system as claimed in claim 12, wherein said control means further includes means for controlling a timing of switching of said solenoid-operated valves such that said selected valve is switched only when the delivery of said pump connected to said selected actuator unit is confirmed to be zero or near zero after, as necessary, a delivery of said pump has been reduced substantially to zero on the basis of a determination by said priority order judging means.

* * * * *